US006131740A

United States Patent [19]

Huang

[11] Patent Number: 6,131,740

[45] Date of Patent: Oct. 17, 2000

[54] TOOLBOX

[76] Inventor: Wen-Kuo Huang, No. 53, Lane 106, Sec. 4, An Ho Rd, Tainan City, Taiwan

[21] Appl. No.: 09/514,902

[22] Filed: Feb. 28, 2000

[51] Int. Cl.[7] ..... B65D 5/50; B65D 85/28

[52] U.S. Cl. ..... 206/759; 206/45.23; 206/372

[58] Field of Search ..... 206/372, 373, 206/374–379, 751, 752, 45, 20, 769, 774, 775, 45.23, 756, 759; 211/60.1, 69, 70.6

[56] References Cited

U.S. PATENT DOCUMENTS

| | | | |
|---|---|---|---|
| 4,930,628 | 6/1990 | Bridges | 206/45.23 |
| 5,692,609 | 12/1997 | Lin | 206/379 |
| 5,775,499 | 7/1998 | Budert | 206/759 |
| 5,823,353 | 10/1998 | Perrin et al. | 206/752 |
| 5,918,741 | 7/1999 | Vasudeva | 206/372 |
| 5,927,493 | 7/1999 | Colombo | 206/372 |
| 6,050,409 | 4/2000 | Delbeck et al. | 206/379 |

*Primary Examiner*—Bryon P. Gehman
*Assistant Examiner*—Luan K. Bui
*Attorney, Agent, or Firm*—Charles E. Baxley

[57] ABSTRACT

A notebook type toolbox includes a casing and a cover pivotally connected to and releasably engaged with the casing. The casing includes shaped grooves for receiving tools and a handle. A bottom of the casing includes two pivotal sections in two ends thereof, respectively. Each of two lower corner areas of the casing is cut to form a space. Each of two lateral walls of the casing includes an end face facing the space. The cover has two lateral sides with a view opening therebetween. Each lateral side has a pivotal section pivotally engaged with an associated pivotal section on the casing. The cover is pivotable to a first position for engaging with the casing in which the tools can be viewed via the view opening and a second position that supports the casing in an inclined status in which the end faces rest on an outer side of the cover.

7 Claims, 5 Drawing Sheets

TOOLBOX

BACKGROUND OF THE INVENTION

1. Field of the Invention

The present invention relates to a notebook type toolbox that may be used as a display device for tools and that allows easy access to the tools and provides reliable tool-retaining effect.

2. Description of the Related Art

FIG. 7 of the drawings illustrates a conventional toolbox having an upper casing 1' and a lower casing 2'. Each casing 1', 2' has a number of shaped grooves 11', 21' for receiving tools of different shapes and sizes. Each casing 1', 2' further has a handle 13, 23' for easy carriage. The upper casing 1' includes an engaging member 12' and the lower casing 2' has an engaging groove 22' for releasably engaging with the engaging member 12', thereby preventing falling of the tools out of the toolbox.

A drawback of such a toolbox is that the user cannot know what types of tools are carried in the toolbox unless it is opened. The toolbox cannot be used to display the tools therein, as the casings 1' and 2' both lie on the ground or table. In addition, the tools tend to fall out of the toolbox when the toolbox is opened, as no retaining member is provided to retain the tools in place.

The present invention is intended to provide an improved toolbox that mitigates and/or obviates the above problems.

SUMMARY OF THE INVENTION

A toolbox in accordance with the present invention comprises a casing and a cover pivotally connected to and releasably engaged with the casing. The casing includes a plurality of shaped grooves for receiving tools and a handle. The casing includes a bottom having two first pivotal sections formed on two ends thereof, respectively. Each of two lower corner areas of the casing is cut to form a space. Each of two lateral walls of the casing includes an end face facing the space. The cover has two lateral sides with a view opening therebetween. Each lateral side has a second pivotal section pivotally engaged with an associated first pivotal section on the casing, thereby allowing relative pivotal movement between the cover and the casing. The cover is pivotable to a first position for engaging with the casing in which the tools are viewed via the view opening and a second position that supports the casing in an inclined status in which the end faces rest on an outer side of the cover.

The pivotal sections of the casing are two holes in two lateral end faces of the bottom, respectively, and the pivotal sections of the cover are pintles pivotally received in the holes.

The cover is substantially U-shape and has two arms. Each of two lateral sides of the casing has a recess in a lower portion thereof for receiving an associated arm of the cover when the casing is engaged with the cover. An end wall defining each recess has an engaging member formed thereon. The cover has two engaging members for releasably engaging with the engaging members on the casing. Each end face includes a first engaging portion, and each arm includes a second engaging portion configured to releasably engage with the first engaging portion of the casing when the casing is supported in the inclined status.

The casing has a handle pivotally attached thereto and a recessed portion is defined in a rear side of the casing thereof for receiving the handle.

Thus, the toolbox in accordance with the present invention is configured as a notebook and can be easily carried and supported in an inclined status for use or display.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
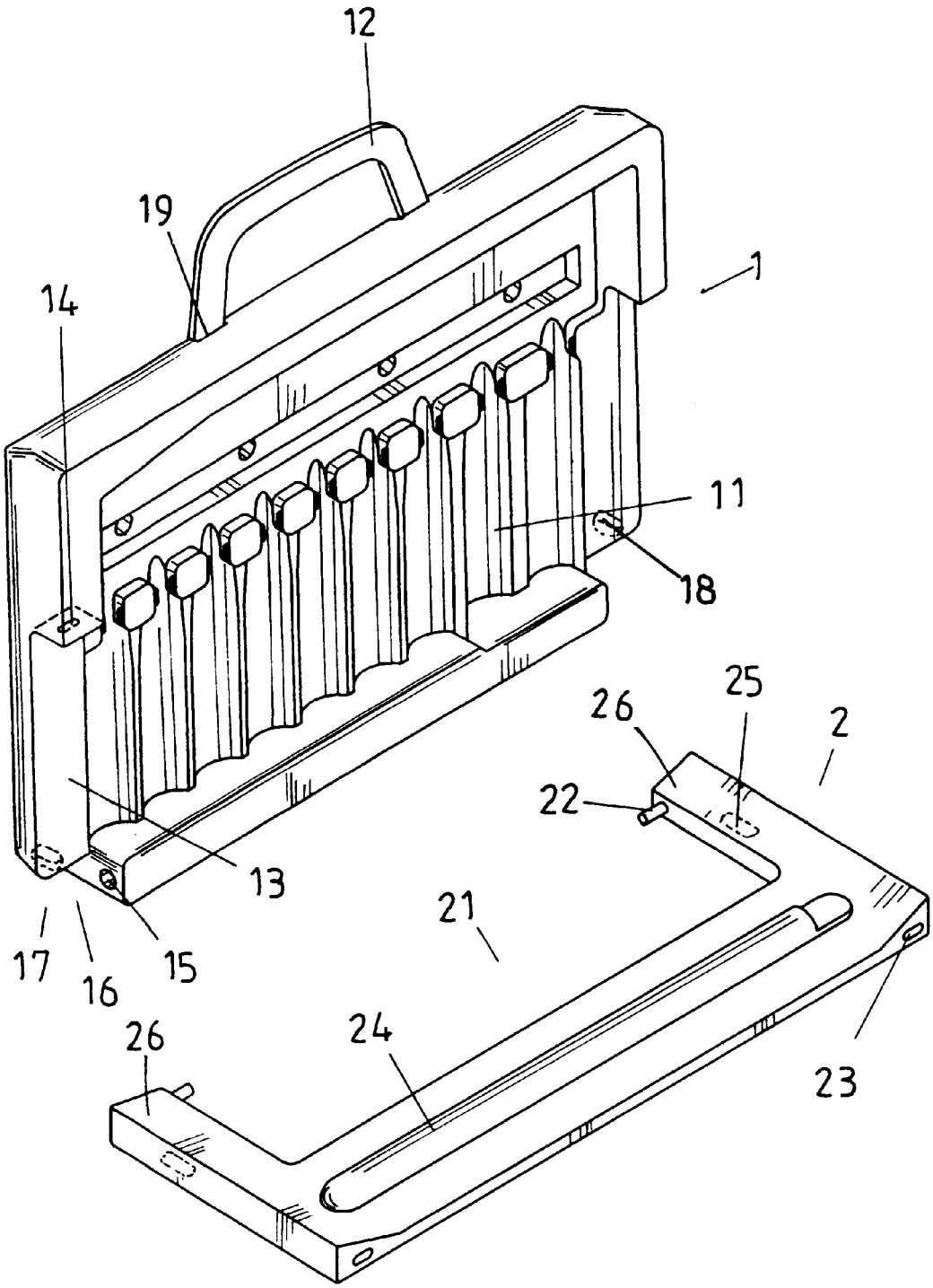
FIG. 1 is an exploded perspective view of a toolbox in accordance with the present invention.
Figure 2:
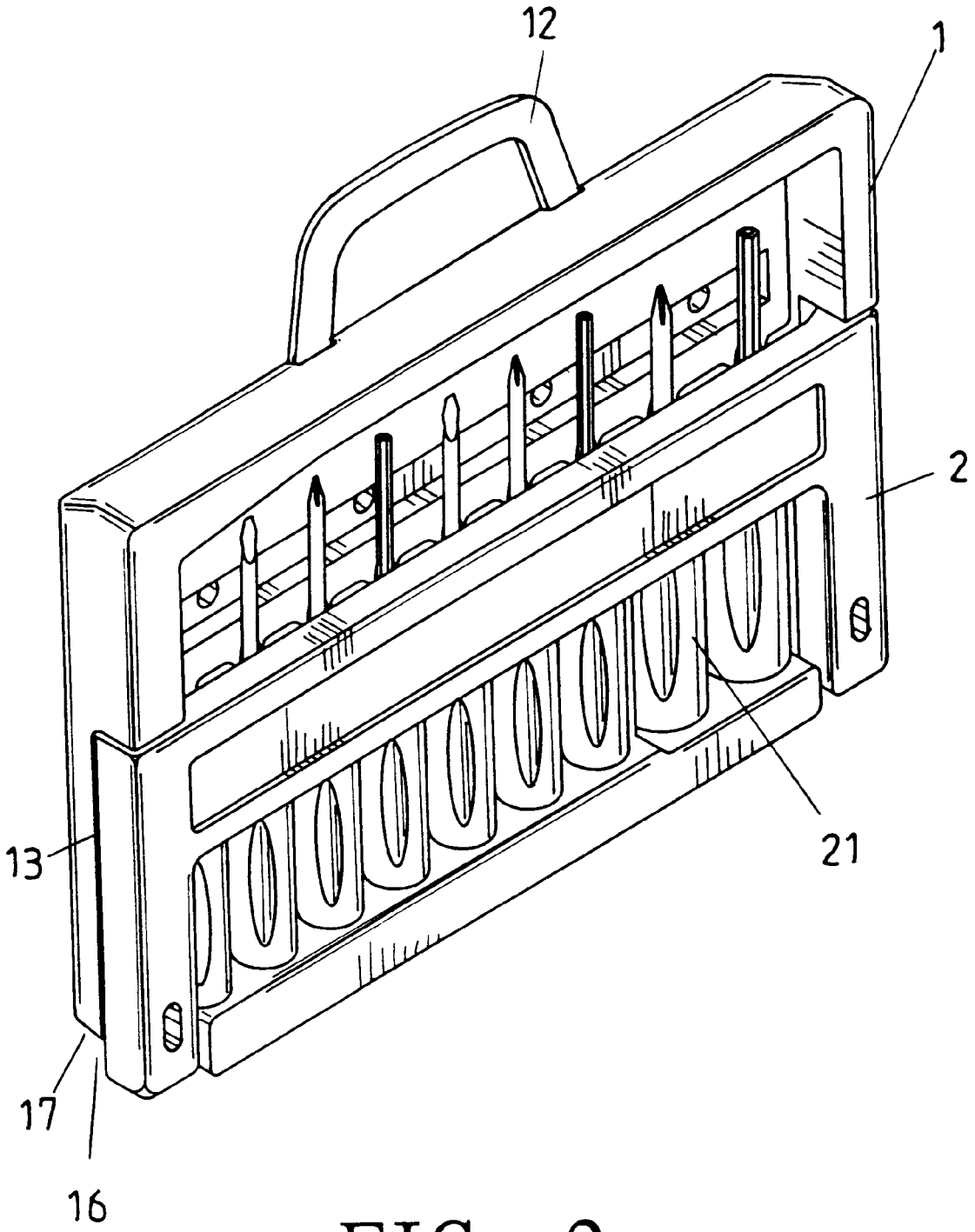
FIG. 2 is a front perspective view of the toolbox in accordance with the present invention.

Referring to FIGS. 1, 2, 5, and 6, a toolbox in accordance with the present invention generally includes a casing 1 and a cover 2. The casing 1 includes a plurality of shaped grooves 11 defined in a side thereof for receiving tools of different shapes and sizes. The casing 1 further includes a handle 12 formed on top thereof. Each of two lateral walls of the casing 1 includes a recess 13 in a lower portion thereof, and an engaging member 14 is provided on an end face defining the recess 13. A bottom of the casing 1 includes two pivotal sections 15 (in the form of holes) in two lateral end faces thereof, respectively. Each of two lower comer areas of the casing 1 is cut to form a space 16. Thus, each of two lateral walls of the casing 1 includes an end face 17 facing the space 16. Each end face 17 further includes an engaging portion 18.

The cover 2 is substantially U-shape and has two arms 26 with a view opening 21 therebetween. Each arm 26 has a pivotal section 22 (in the form of a pintle) formed thereon. The pintle 22 is pivotally engaged in an associated hole 15, thereby allowing relative pivotal movement between the cover 2 and the casing 1. The cover 2 further includes engaging members 23 for releasably engaging with the engaging members 14 on the casing 1. The cover 2 further includes a retaining ridge 24 on an inner side thereof that faces the shaped grooves 11. Each arm 26 further includes an engaging portion 25 configured to releasably engage with the engaging portion 18 of the casing 1.

In assembly, the pintles 22 of the cover 2 are pivotally received in the holes 15 of the casing 1. In use, after inserting tools into corresponding shaped grooves 11 in the casing 1, the cover 2 is pivoted to a position shown in FIG. 2 such that the tools may be retained in place by the retaining ridge 24 (FIG. 5), which is useful for carriage. In addition, all of the tools may be directly viewed via the view opening 21 in the cover 2. Thus, the user may check the tools without opening the toolbox. The casing 1 and the cover 2 are securely engaged together by means of engagement between the engaging members 14 and 23. The recesses 13 of the casing 1 receive two arms 26 of the cover 2, thereby providing an aesthetically pleasing effect.

Figure 4:
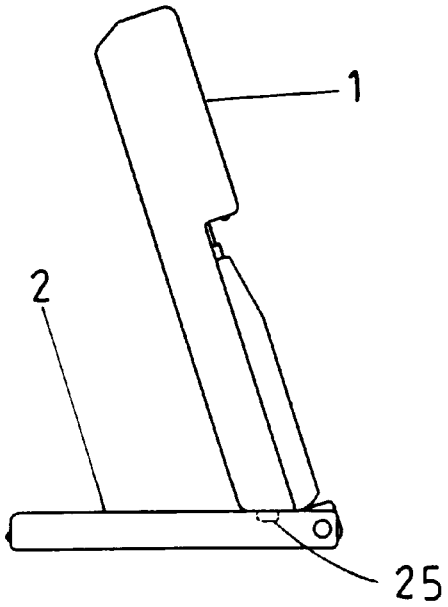
FIG. 4 is a side view of the toolbox in FIG. 2 in a status for display or use.
Figure 5:
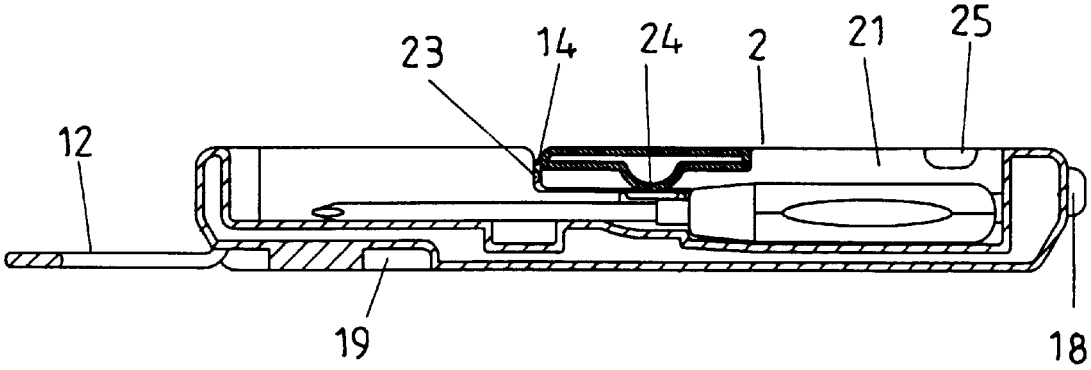
FIG. 5 is a sectional view of the toolbox in accordance with the present invention.
Figure 6:
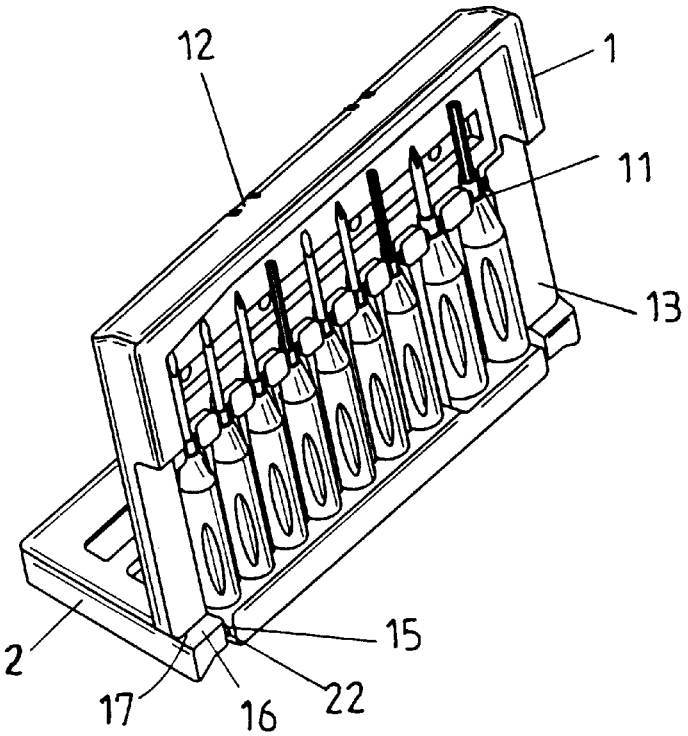
FIG. 6 is a perspective view of the toolbox in a status for display or use.
Figure 7:
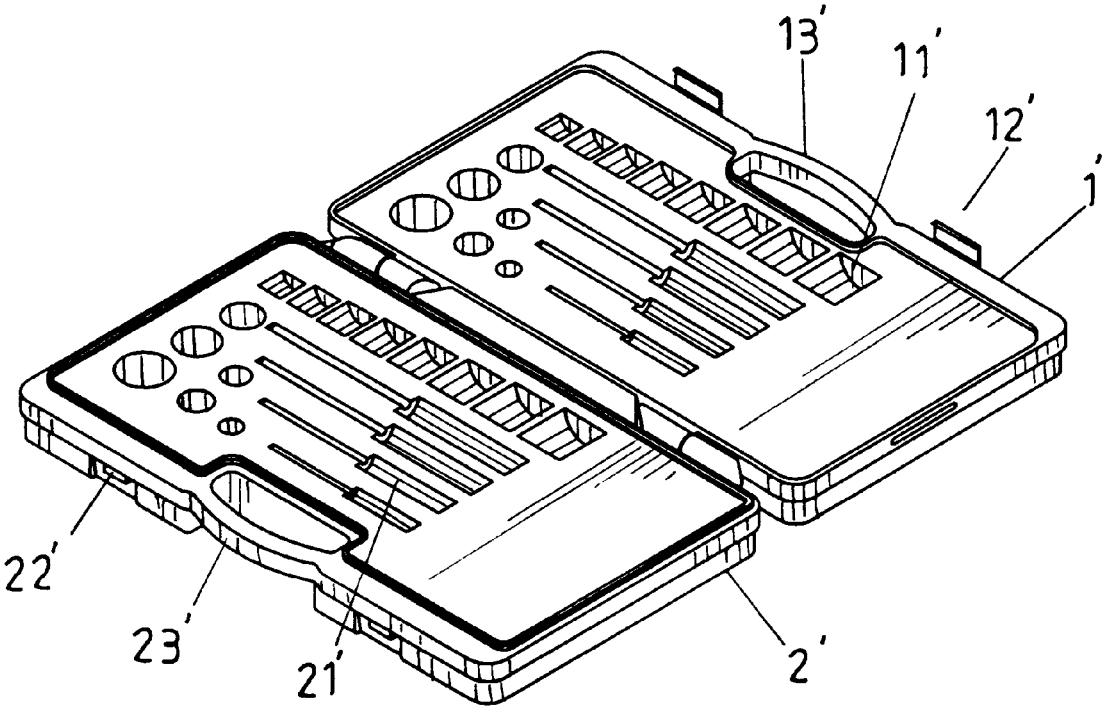
FIG. 7 Prior Art
FIG. 7 is a perspective view of a conventional toolbox.

When the user intends to use the tools or display the tools, the cover 2 may be pivoted to a position shown in FIGS. 4 and 6 until the outer side of the cover 2 abuts the end faces 17 of the casing 1, thereby providing a reliable support for the casing 1 in an inclined status. Thus, the tools in the casing 1 may be displayed or accessed easily. The toolbox is reliably retained in the inclined status by means of engagement between the engaging portions 18 and 25.

Figure 3:
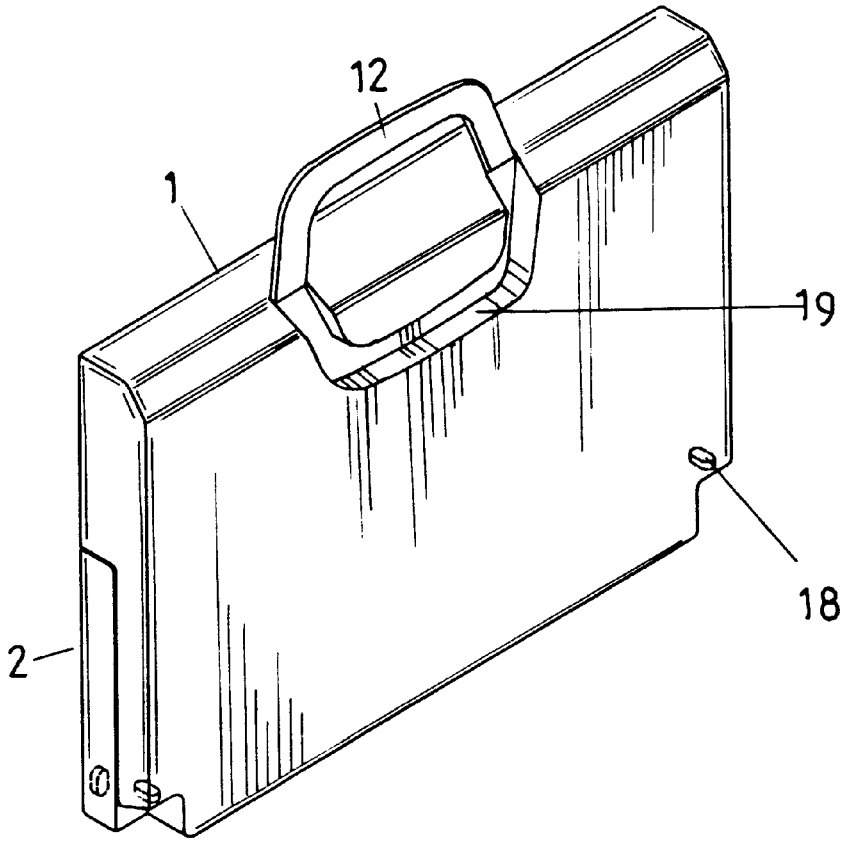
FIG. 3 is a rear perspective view of the toolbox in accordance with the present invention.

Referring to FIG. 3, the casing 1 may include a recessed portion 19 in a rear side thereof for receiving the handle 12 that is pivotally attached to the casing 1. Thus, the overall appearance for the toolbox is aesthetically pleasing when in the status for use or display, best shown in FIGS. 4 and 6. Thus, the toolbox in accordance with the present invention is configured as a notebook and can be easily carried and supported in an inclined status for use or display.

Although the invention has been explained in relation to its preferred embodiment, it is to be understood that many other possible modifications and variations can be made without departing from the spirit and scope of the invention as hereinafter claimed.

What is claimed is:

1. A toolbox comprising a casing and a cover pivotally connected to and releasably engaged with the casing, the casing including a plurality of shaped grooves for receiving tools and a handle, the casing including a bottom having two first pivotal sections formed on two ends thereof, respectively, each of two lower corner areas of the casing being cut to form a space, each of two lateral walls of the casing including an end face facing the space, the cover having two lateral sides with a view opening therebetween, each lateral side having a second pivotal section pivotally engaged with an associated said first pivotal section on the casing, thereby allowing relative pivotal movement between the cover and the casing, the cover being pivotable to a first position for engaging with the casing in which the tools are viewed via the view opening and a second position that supports the casing in an inclined status in which the end faces rest on an outer side of the cover.

2. The toolbox as claimed in claim 1, wherein the pivotal sections of the casing are two holes in two lateral end faces of the bottom, respectively, and the pivotal sections of the cover are pintles pivotally received in the holes.

3. The toolbox as claimed in claim 1, wherein the cover is substantially U-shape and has two arms.

4. The toolbox as claimed in claim 3, wherein each of two lateral sides of the casing has a recess in a lower portion thereof for receiving an associated said arm of the cover when the casing is engaged with the cover.

5. The toolbox as claimed in claim 4, wherein an end wall defining each said recess has an engaging member formed thereon, and the cover has two engaging members for releasably engaging with the engaging members on the casing.

6. The toolbox as claimed in claim 3, wherein each said end face includes a first engaging portion, and wherein each said arm further includes a second engaging portion configured to releasably engage with the first engaging portion of the casing when the casing is supported in the inclined status.

7. The toolbox as claimed in claim 1, wherein the casing has a handle pivotally attached thereto, the casing further including a recessed portion in a rear side thereof for receiving the handle.

* * * * *